US010358798B2

(12) United States Patent
Ohigashi et al.

(10) Patent No.: US 10,358,798 B2
(45) Date of Patent: Jul. 23, 2019

(54) WORK VEHICLE AND METHOD OF CONTROLLING OPERATION

(71) Applicant: KOMATSU LTD., Tokyo (JP)

(72) Inventors: Koji Ohigashi, Hirakata (JP); Kimihiro Mori, Hirakata (JP); Kazuki Kumagai, Hiratsuka (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 15/326,683

(22) PCT Filed: Feb. 8, 2016

(86) PCT No.: PCT/JP2016/053663
§ 371 (c)(1),
(2) Date: Jan. 17, 2017

(87) PCT Pub. No.: WO2017/138070
PCT Pub. Date: Aug. 17, 2017

(65) Prior Publication Data

US 2018/0030691 A1 Feb. 1, 2018

(51) Int. Cl.
*E02F 9/22* (2006.01)
*E02F 3/32* (2006.01)
(Continued)

(52) U.S. Cl.
CPC ..... *E02F 9/2228* (2013.01); *E02F 3/32* (2013.01); *E02F 3/425* (2013.01); *E02F 3/435* (2013.01); *E02F 9/2066* (2013.01); *E02F 9/2235* (2013.01); *E02F 9/2267* (2013.01); *E02F 9/2271* (2013.01); *E02F 9/2292* (2013.01); *E02F 9/2296* (2013.01)

(58) Field of Classification Search
CPC ..... F16D 31/02; G06F 19/00; F02F 9/2228
See application file for complete search history.

(56) References Cited

U.S. PATENT DOCUMENTS 5,782,018 A 7/1998 Tozawa et al.
5,848,531 A * 12/1998 Nakamura ..... E02F 9/2228 60/426
(Continued)

FOREIGN PATENT DOCUMENTS

JP H03-55323 A 3/1991
JP H04-26263 U 3/1992
(Continued)

*Primary Examiner* — Alex C Dunn
(74) *Attorney, Agent, or Firm* — Drinker Biddle & Reath LLP

(57) ABSTRACT

A work vehicle detects pressure of hydraulic oil supplied to an arm cylinder. The work vehicle determines operation details for an arm. The work vehicle includes a relief valve capable of setting a relief pressure of hydraulic oil in a hydraulic circuit at one of a first set pressure and a second set pressure that is greater than the first set pressure. The work vehicle sets the relief pressure of the relief valve at the first set pressure, on the conditions that the detected pressure is equal to or greater than a predetermined value, and that it is determined that the operation details indicate an excavation operation. The work vehicle sets the relief pressure of the relief valve at the second set pressure when the conditions are not satisfied.

10 Claims, 6 Drawing Sheets

(51) Int. Cl.

| | |
|---|---|
| ***E02F 3/42*** | (2006.01) |
| ***E02F 3/43*** | (2006.01) |
| ***E02F 9/20*** | (2006.01) |

(56) References Cited

U.S. PATENT DOCUMENTS

| | | | | |
|---|---|---|---|---|
| 5,855,159 | A | 1/1999 | Yoshida et al. | |
| 6,169,948 | B1 * | 1/2001 | Fujishima | E02F 3/435 172/4.5 |
| 6,317,669 | B1 * | 11/2001 | Kurenuma | E02F 3/434 172/2 |
| 7,954,315 | B2 * | 6/2011 | Yamashita | E02F 9/2239 60/421 |
| 8,554,401 | B2 * | 10/2013 | Satake | E02F 9/226 701/29.1 |
| 8,567,186 | B2 * | 10/2013 | Hyodo | F16H 61/47 60/420 |
| 8,886,415 | B2 * | 11/2014 | Shatters | E02F 3/432 414/700 |
| 8,974,171 | B2 * | 3/2015 | Shirao | E02F 3/432 414/685 |
| 2006/0048508 | A1 * | 3/2006 | Nakamura | E02F 9/2228 60/422 |
| 2007/0227137 | A1 | 10/2007 | Naruse | |
| 2010/0024412 | A1 * | 2/2010 | Hyodo | B60W 10/30 60/426 |
| 2012/0093624 | A1 * | 4/2012 | Ohhigashi | E02F 9/2203 414/722 |
| 2012/0245805 | A1 * | 9/2012 | Yamaguchi | F16H 61/143 701/50 |
| 2012/0310495 | A1 * | 12/2012 | Nakanishi | E02F 9/2066 701/50 |
| 2014/0283508 | A1 * | 9/2014 | Hiraku | F15B 7/006 60/328 |
| 2016/0237655 | A1 * | 8/2016 | Baba | E02F 3/437 |
| 2016/0251836 | A1 * | 9/2016 | Baba | E02F 3/435 701/50 |

FOREIGN PATENT DOCUMENTS

| | | | |
|---|---|---|---|
| JP | 2009-138495 | A | 6/2009 |
| JP | 2010-156134 | A | 7/2010 |
| JP | 2013-053740 | A | 3/2013 |
| JP | 2013-245457 | A | 12/2013 |
| WO | WO-2004/053337 | A1 | 6/2004 |
| WO | WO-2005/108797 | A1 | 11/2005 |
| WO | WO-2015/152775 | A1 | 10/2015 |

* cited by examiner

WORK VEHICLE AND METHOD OF CONTROLLING OPERATION

TECHNICAL FIELD

The present invention relates to a work vehicle and a method of controlling an operation.

BACKGROUND ART

Conventionally, work vehicles such as a hydraulic excavator have been known. For example, Japanese Utility Model Laying-Open No. 04-26263 (PTD 1) discloses a power excavator configured to have an actuator that is supplied with pressurized oil discharged from a hydraulic pump to drive a boom, an arm and a bucket via a work implement hydraulic circuit, thereby operating the boom, the arm and the bucket.

Specifically, the power excavator in PTD 1 has a heavy lifting (power-up) function. Specifically, the power excavator includes: a variable-type relief valve configured to variably set the pressure inside the work implement hydraulic circuit at two levels including a high level and a low level; detection means for detecting each of the operation states of the boom, the arm and the bucket; and means for variably-operating the variable-type relief valve. The means for variably-operating the variable-type relief valve is configured to variably-operate the variable-type relief valve so as to set the pressure inside the work implement hydraulic circuit at a high pressure at the time when the detecting means detects that the arm and the bucket each are fixed at a fixed position and that the boom is raised.

Thus, according to the power excavator in PTD 1, power-up is implemented on the conditions that "the arm and the bucket each are fixed at a fixed position" and "the boom is operated".

CITATION LIST

Patent Document

PTD 1: Japanese Utility Model Laying-Open No. 04-26263

SUMMARY OF INVENTION

Technical Problem

According to the technique disclosed in PTD 1, however, it cannot be accurately determined whether excavation is currently performed or not (specifically, whether or not the ground is excavated in the state where at least a cutting edge of the bucket is in contact with the excavation surface such as the ground), thereby increasing the possibility that power-up cannot be implemented, for example, also during hoist revolution. This is because not only a boom operation but also an arm or bucket operation may also be performed (that is, combined operations may be performed) during hoist revolution.

The present invention has been made in light of the above-described problems. An object of the present invention is to provide: a work vehicle capable of implementing power-up during operations other than excavation by determining more accurately than ever before whether excavation is currently performed or not; and a method of controlling an operation performed in the work vehicle.

Solution to Problem

According to an aspect of the present invention, a work vehicle includes: a vehicle main body; a work implement attached to the vehicle main body and including an arm connected to a bucket; an arm cylinder configured to operate the arm with hydraulic oil supplied through a hydraulic circuit; a pressure detection unit for detecting pressure of the hydraulic oil supplied to the arm cylinder; an operation details determination unit for determining operation details for the arm; a relief valve capable of setting a relief pressure of the hydraulic oil in the hydraulic circuit at one of a first set pressure and a second set pressure higher than the first set pressure; and a relief pressure setting unit for setting the relief pressure of the relief valve at the first set pressure on conditions that the pressure detected by the pressure detection unit is equal to or greater than a predetermined value, and that the operation details determination unit determines that the operation details indicate an excavation operation, and for setting the relief pressure of the relief valve at the second set pressure when the conditions are not satisfied.

In the above-described configuration, when the detected pressure is not equal to or greater than the predetermined value even if it is determined that the operation details indicate an excavation operation, it is considered that the bucket is not in contact with an excavation surface such as the ground (that is, the excavation operation is not currently performed). In such a case, the work vehicle sets the relief pressure at the second set pressure higher than the first set pressure, thereby implementing power-up. Accordingly, the work vehicle can accurately determine whether excavation is currently performed or not, and also can implement power-up in operations other than those during excavation. Furthermore, the operations other than those during excavation can be performed immediately as compared with the case where the operations other than those during excavation are performed without implementing power-up. Thus, a series of operations including an excavation operation can be immediately performed. Furthermore, since the work vehicle performs the excavation operation without implementing power-up, the load to be applied onto the work vehicle can be reduced as compared with the case where the excavation operation is performed in the state where power-up is implemented.

The pressure detection unit is configured to detect the pressure of the hydraulic oil on a side of a bottom of the arm cylinder.

According to the above-described configuration, the pressure of the hydraulic oil in the arm cylinder can be detected more accurately than in the configuration in which the pressure of the hydraulic oil in other positions of the arm cylinder is detected.

According to another aspect of the present invention, a work vehicle includes: a vehicle main body; a work implement attached to the vehicle main body and including a bucket; a bucket cylinder configured to operate the bucket with hydraulic oil supplied through a hydraulic circuit; a pressure detection unit for detecting pressure of the hydraulic oil supplied to the bucket cylinder; an operation details determination unit for determining operation details for the bucket; a relief valve capable of setting a relief pressure of the hydraulic oil in the hydraulic circuit at one of a first set pressure and a second set pressure higher than the first set pressure; and a relief pressure setting unit for setting the relief pressure of the relief valve at the first set pressure on conditions that the pressure detected by the pressure detection unit is equal to or greater than a predetermined value, and that the operation details determination unit determines that the operation details indicate an excavation operation, and for setting the relief pressure of the relief valve at the second set pressure when the conditions are not satisfied.

In the above-described configuration, when the detected pressure is not equal to or greater than the predetermined value even if it is determined that the operation details indicate an excavation operation, it is considered that the bucket is not in contact with the excavation surface such as the ground (that is, the excavation operation is not currently performed). In such a case, the work vehicle sets the relief pressure at the second set pressure higher than the first set pressure, thereby implementing power-up. Accordingly, the work vehicle can accurately determine whether excavation is currently performed or not, and also can implement power-up in operations other than those during excavation. Furthermore, since the operations other than those during excavation can be performed immediately as compared with the case where the operations other than those during excavation are performed without implementing power-up. Thus, a series of operations including an excavation operation can be immediately performed. Furthermore, since the work vehicle performs the excavation operation without implementing power-up, the load to be applied onto the work vehicle can be reduced as compared with the case where the excavation operation is performed in the state where power-up is implemented.

The pressure detection unit is configured to detect the pressure of the hydraulic oil on a side of a bottom of the bucket cylinder.

According to the above-described configuration, the pressure of the hydraulic oil in the bucket cylinder can be detected more accurately than in the configuration in which the pressure of the hydraulic oil in other positions of the bucket cylinder is detected.

Preferably, the work vehicle further includes: an engine; a control unit for controlling the work implement utilizing an output of the engine; and a storage unit for storing, as a horsepower curve of the engine, a first horsepower curve and a second horsepower curve that is greater in horsepower than the first horsepower curve. The control unit is configured to control the work implement using the first horsepower curve when the conditions are satisfied, and control the work implement using the second horsepower curve when the conditions are not satisfied.

According to the above-described configuration, when the conditions are not satisfied, a series of operations including an excavation operation can be performed immediately as compared with the case where the relief pressure is only set at the second set pressure.

Preferably, the work vehicle further includes an engine; and a control unit for controlling a rotation speed of the engine and controlling the work implement utilizing an output of the engine. The control unit is configured to increase the rotation speed of the engine to be higher when the conditions are not satisfied than when the conditions are satisfied.

According to the above-described configuration, when the conditions are not satisfied, a series of operations including an excavation operation can be performed immediately as compared with the case where the relief pressure is only set at the second set pressure.

According to still another aspect of the present invention, a method of controlling an operation is performed in a work vehicle. The work vehicle includes: a vehicle main body; a work implement attached to the vehicle main body and including an arm connected to a bucket; an arm cylinder configured to operate the arm with hydraulic oil supplied through a hydraulic circuit; and a relief valve capable of setting a relief pressure of the hydraulic oil in the hydraulic circuit at one of a first set pressure and a second set pressure higher than the first set pressure. The method of controlling an operation includes: detecting pressure of the hydraulic oil supplied to the arm cylinder; determining operation details for the arm; and setting the relief pressure of the relief valve at the first set pressure on conditions that the pressure detected is equal to or greater than a predetermined value, and that it is determined that the operation details indicate an excavation operation, and setting the relief pressure of the relief valve at the second set pressure when the conditions are not satisfied.

In the above-described configuration, when the detected pressure is not equal to or greater than the predetermined value even if it is determined that the operation details indicate an excavation operation, it is considered that the bucket is not in contact with the excavation surface such as the ground (that is, the excavation operation is not currently performed). In such a case, the work vehicle sets the relief pressure at the second set pressure higher than the first set pressure, thereby implementing power-up. Accordingly, the work vehicle can accurately determine whether excavation is currently performed or not, and also can implement power-up in operations other than those during excavation. Furthermore, the operations other than those during excavation can be performed immediately as compared with the case where the operations other than those during excavation are performed without implementing power-up. Thus, a series of operations including an excavation operation can be immediately performed. Furthermore, since the work vehicle performs the excavation operation without implementing power-up, the load to be applied onto the work vehicle can be reduced as compared with the case where the excavation operation is performed in the state where power-up is implemented.

According to still another aspect of the present invention, a method of controlling an operation is performed in a work vehicle. The work vehicle includes: a vehicle main body; a work implement attached to the vehicle main body and including a bucket; a bucket cylinder configured to operate the bucket with hydraulic oil supplied through a hydraulic circuit; a relief valve capable of setting a relief pressure of the hydraulic oil in the hydraulic circuit at one of a first set pressure and a second set pressure higher than the first set pressure. The method of controlling an operation includes: detecting pressure of the hydraulic oil supplied to the bucket cylinder; determining operation details for the bucket; and setting the relief pressure of the relief valve at the first set pressure on conditions that the pressure detected is equal to or greater than a predetermined value, and that it is determined that the operation details indicate an excavation operation, and setting the relief pressure of the relief valve at the second set pressure when the conditions are not satisfied.

In the above-described configuration, when the detected pressure is not equal to or greater than the predetermined value even if it is determined that the operation details indicate an excavation operation, it is considered that the bucket is not in contact with the excavation surface such as the ground (that is, the excavation operation is not currently performed). In such a case, the work vehicle sets the relief pressure at the second set pressure higher than the first set pressure, thereby implementing power-up. Accordingly, the work vehicle can accurately determine whether excavation is currently performed or not, and also can implement power-up in operations other than those during excavation. Furthermore, the operations other than those during excavation can be performed immediately as compared with the case where the operations other than those during excavation are performed without implementing power-up. Thus, a series of operations including an excavation operation can be immediately performed. Furthermore, since the work vehicle performs the excavation operation without implementing power-up, the load to be applied onto the work vehicle can be reduced as compared with the case where the excavation operation is performed in the state where power-up is implemented.

Advantageous Effects of Invention

According to the present invention, it is accurately determined whether excavation is currently performed or not, so that power-up can be implemented in operations other than those during excavation.

DESCRIPTION OF EMBODIMENTS

Figure 1:
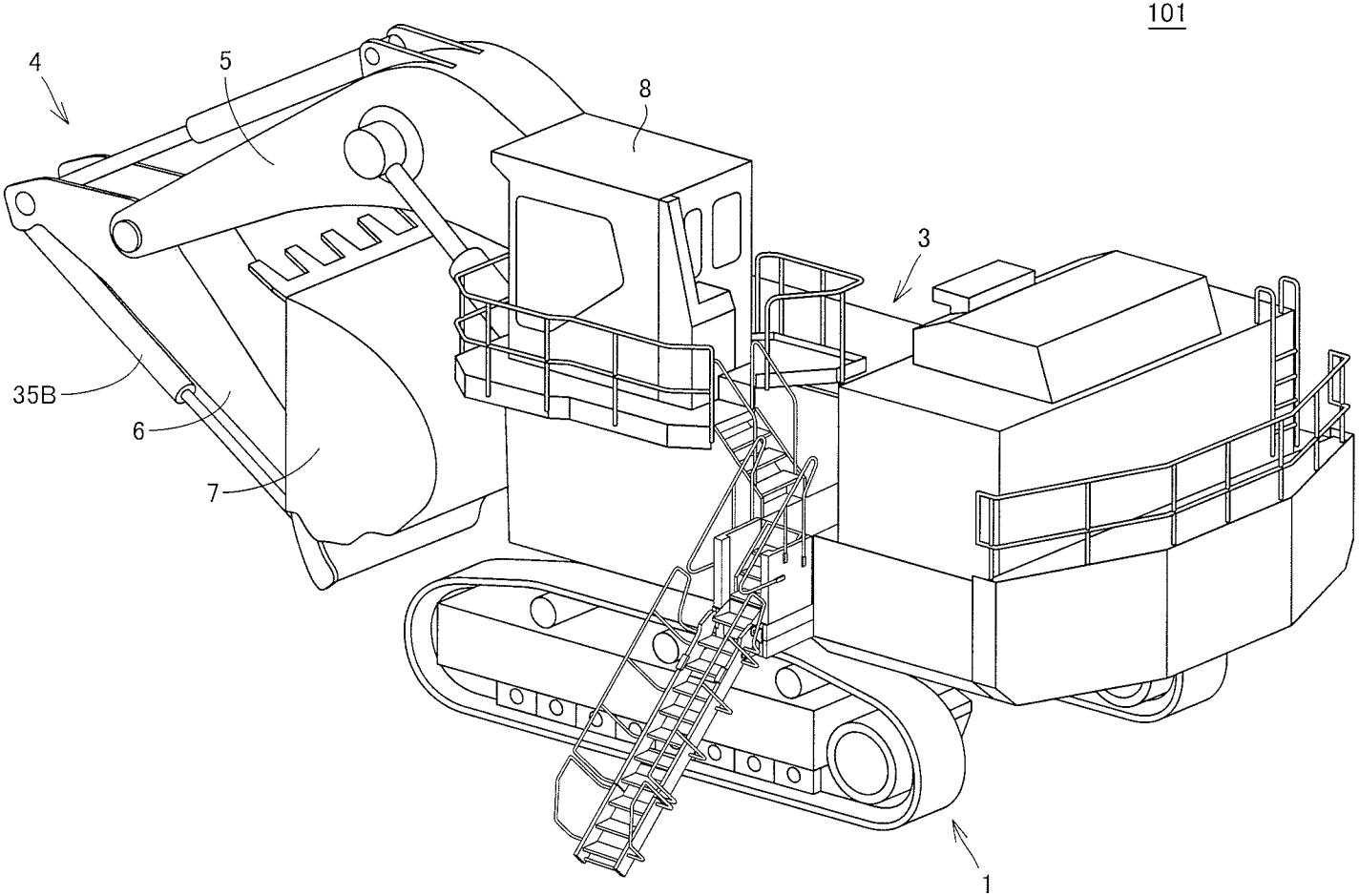
FIG. 1 is a diagram illustrating an external appearance of a work vehicle according to an embodiment.

A work vehicle according to each embodiment will be hereinafter described. In the following description, the same components are designated by the same reference characters. Names and functions thereof are also the same. Accordingly, the detailed description thereof will not be repeated.

When paying attention to one optional operation among a plurality of specific operations (typically, a lifting-up operation), a work vehicle may take at least one of the first state where energy consumption per unit time is relatively small and the second state where energy consumption per unit time is greater than that in the first state.

Typically, the first state is shifted to the second state on the condition that the operation mode is shifted from the default operation mode to another operation mode by a prescribed operation performed by an operator. Furthermore, shifting from the first state to the second state is implemented by raising the relief pressure of the relief valve connected to a hydraulic pump by way of example.

However, during the excavation operation using a bucket (specifically, when the ground is excavated in the state where at least the cutting edge of the bucket is in contact with the excavation surface such as the ground), shifting from the first state to the second state is not implemented in order to prevent an excessive load to be applied onto the work implement. On the other hand, shifting from the first state to the second state is implemented during a plurality of moving operations for moving excavated materials excavated by the excavation operation.

Examples of the moving operation may include a boom raising operation, a hoist revolving operation, a dumping operation, and the like. Furthermore, it is preferable that shifting from the first state to the second state is implemented also during the downward revolving operation that is performed after the dumping operation.

The following is a detailed explanation about the process for determining whether the excavation operation is currently performed or not, and about the change of the operation mode based on this determination result.

A. ENTIRE CONFIGURATION

FIG. 1 is a diagram illustrating an external appearance of a work vehicle 101 according to an embodiment. As shown in FIG. 1, a hydraulic excavator will be mainly described as an example of work vehicle 101 in the present example. More preferably, work vehicle 101 is a hydraulic excavator for mining.

Work vehicle 101 mainly includes a traveling unit 1, a revolving unit 3, and a work implement 4. The main body of the work vehicle is formed of traveling unit 1 and revolving unit 3. Traveling unit 1 includes a pair of crawler belts on the right and left sides. Revolving unit 3 is mounted so as to be revolvable via a revolving mechanism in an upper portion of traveling unit 1.

Work implement 4 is pivotally supported on revolving unit 3 so as to be operable in the vertical direction, and configured to perform such work as excavation of soil. Work implement 4 includes a boom 5, an arm 6, and a bucket 7. Boom 5 has a base portion that is movably coupled to revolving unit 3. Arm 6 is movably coupled to an end of boom 5. Bucket 7 is movably coupled to an end of arm 6. Revolving unit 3 also includes an operator's compartment 8 and the like.

Arm 6 is provided with an arm cylinder 35B. Arm 6 is operated by arm cylinder 35B. Arm 6 also includes a pressure gauge (a pressure gauge 44 in FIG. 4) for detecting the pressure of the hydraulic oil supplied to arm cylinder 35B. This pressure gauge detects the hydraulic pressure to be applied to the bottom side of arm cylinder 35B.

B. CONFIGURATION OF OPERATOR'S COMPARTMENT

Figure 2:
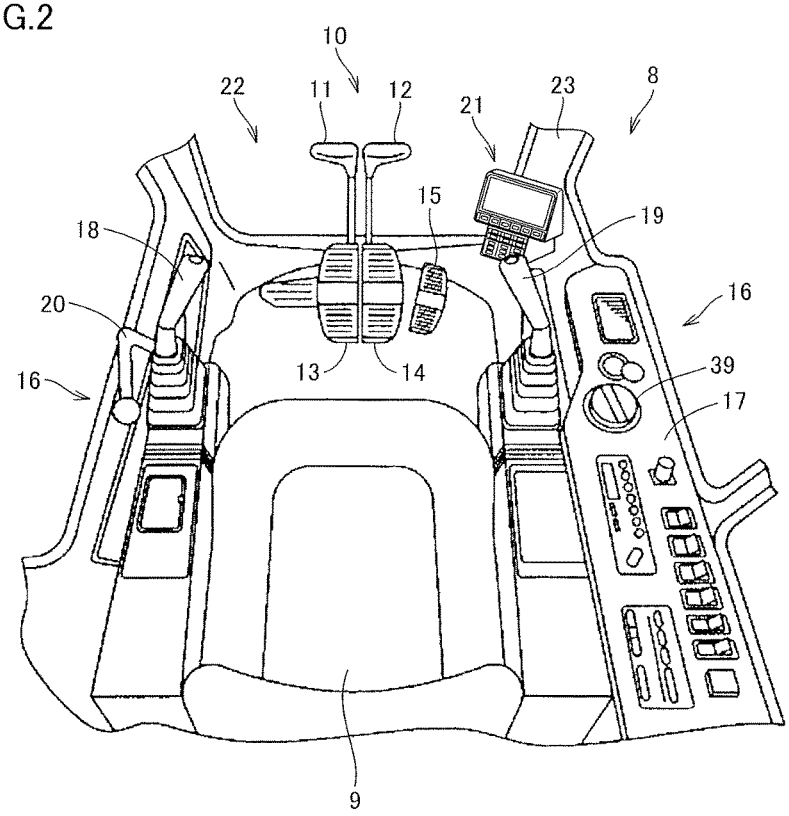
FIG. 2 is a perspective view showing the inner configuration of an operator's compartment.

FIG. 2 is a perspective view showing the inner configuration of operator's compartment 8. As shown in FIG. 2, operator's compartment 8 includes an operator's seat 9, a travel operation unit 10, a pedal for attachment 15, side windows 16 on the right and left sides, a dashboard 17, work implement levers 18, 19, a lock lever 20, a monitor device 21, a front window 22, a vertical frame 23, and a throttle dial 39.

Operator's seat 9 is provided in a central portion of operator's compartment 8. Travel operation unit 10 is provided in front of operator's seat 9.

Travel operation unit 10 includes travel levers 11, 12 and travel pedals 13, 14. Travel pedals 13 and 14 can move together with travel levers 11 and 12, respectively. Traveling unit 1 moves forward when an operator pushes travel levers 11 and 12 forward. Also, traveling unit 1 moves backward when the operator pulls travel levers 11 and 12 backward.

Pedal for attachment 15 is provided in the vicinity of travel operation unit 10. Also, dashboard 17 is provided in the vicinity of side window 16 on the right side in FIG. 2.

Work implement levers 18 and 19 serve as control levers provided on the right and left sides of operator's seat 9. Work implement levers 18, 19 serve to carry out vertical movement of boom 5, pivot of arm 6 and bucket 7, a revolving operation of revolving unit 3, and the like.

Lock lever 20 is provided in the vicinity of work implement lever 18. Lock lever 20 serves to stop such functions as operation of work implement 4, revolution of revolving unit 3, and travel of traveling unit 1. By performing an operation for positioning lock lever 20 in a vertical state (here, an operation for pulling down the lock lever), movement of work implement 4 or the like can be locked (restricted). In the state where movement of work implement 4 or the like is locked by lock lever 20, work implement 4 or the like does not operate even if the operator operates work implement levers 18 and 19. Similarly, even if the operator operates travel levers 11 and 12 and travel pedals 13 and 14, traveling unit 1 does not operate. On the other hand, by performing an operation for positioning lock lever 20 in a horizontal state (here, an operation for pulling up the lock lever), locked (restricted) movement of work implement 4 or the like can be cancelled. This allows work implement 4 or the like to operate.

Monitor device 21 is provided in a lower portion of vertical frame 23 that is a partition between front window 22 and one side window 16 of operator's compartment 8 and it displays an engine state of work vehicle 101, guidance information, warning information, or the like. In addition, monitor device 21 is provided to be able to accept a setting instruction as to various operations of work vehicle 101.

Throttle dial 39 serves as a fuel adjusting dial. Specifically, throttle dial 39 is used for setting the maximum fuel injection quantity.

C. HARDWARE CONFIGURATION

Figure 3:
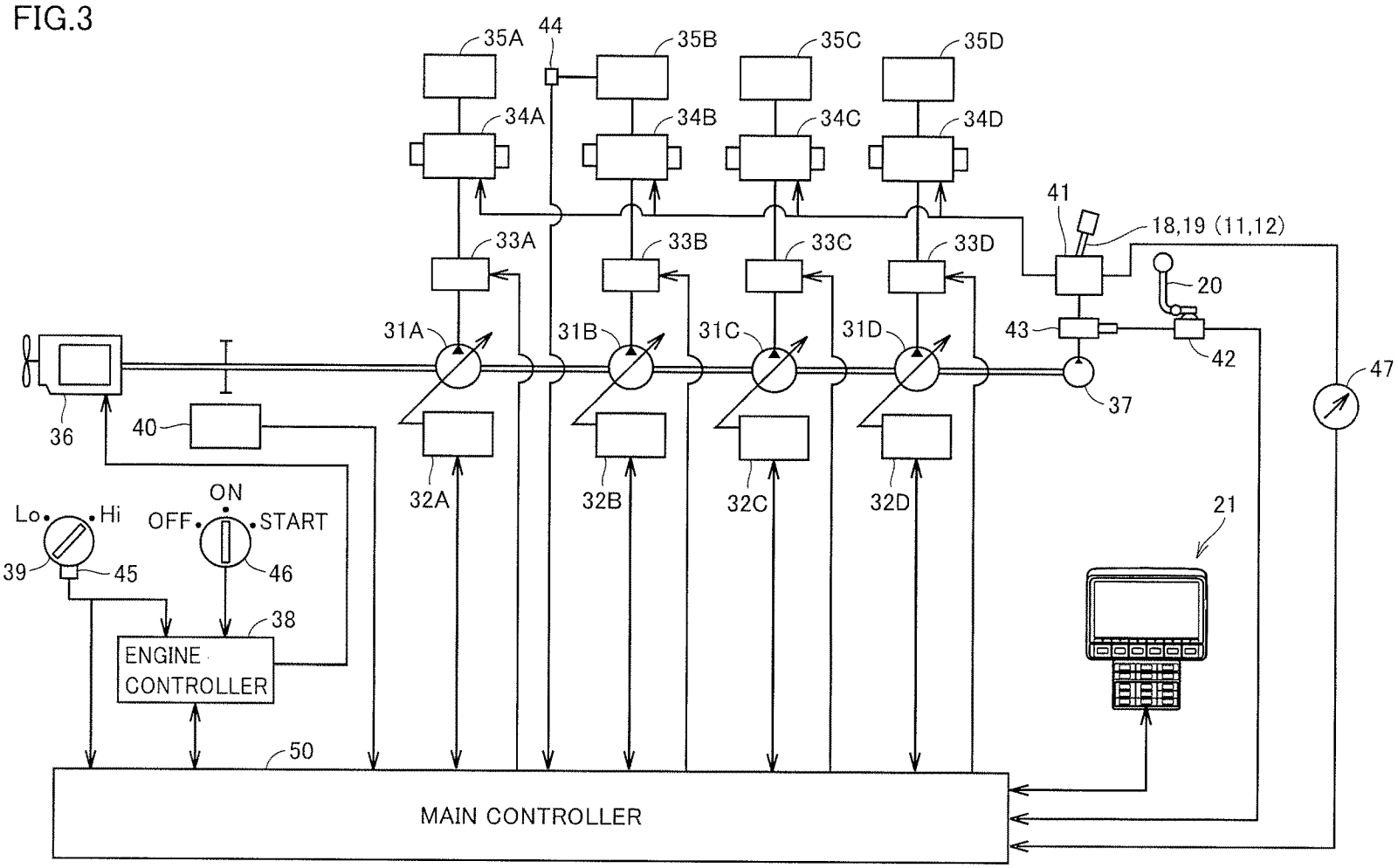
FIG. 3 is a simplified diagram showing the hardware configuration of a control system of the work vehicle.

FIG. 3 is a simplified diagram showing the hardware configuration of a control system in work vehicle 101. As shown in FIG. 3, the control system in work vehicle 101 includes, by way of example, work implement levers 18, 19, travel levers 11, 12, lock lever 20, monitor device 21, an engine 36, a hydraulic pump 37, an engine controller 38, a throttle dial 39, a rotation sensor 40, a work implement lever apparatus 41, a pressure switch 42, a valve 43, a pressure gauge 44, a potentiometer 45, a starter switch 46, a pressure sensor 47, and a main controller 50.

Furthermore, the control system in work vehicle 101 includes hydraulic pumps 31A, 31B, 31C, and 31D, swash plate drive apparatuses 32A, 32B, 32C, and 32D, relief valves 33A, 33B, 33C, and 33D, control valves 34A, 34B, 34C, and 34D, a plurality of actuators (a bucket cylinder 35A, an arm cylinder 35B, a boom cylinder 35C, a hydraulic motor 35D for revolution), and a hydraulic circuit for supplying hydraulic oil to the plurality of actuators and the like.

Hydraulic pumps 31A, 31B, 31C, and 31D each discharge hydraulic oil used for driving work implement 4 or the like. In addition, FIG. 3 shows hydraulic pumps 31A, 31B, 31C, and 31D each as an example of a hydraulic pump that discharges the hydraulic oil used for driving work implement 4 or the like. Hydraulic pump 37 discharges oil utilized for generating a hydraulic pressure (a pilot pressure) in accordance with operations of work implement levers 18, 19 and travel levers 11, 12. Swash plate drive apparatuses 32A, 32B, 32C, and 32D are connected to hydraulic pumps 31A, 31B, 31C, and 31D, respectively.

Swash plate drive apparatuses 32A, 32B, 32C, and 32D each perform a driving operation based on an instruction from main controller 50 and each change an angle of inclination of a swash plate in a corresponding one of hydraulic pumps 31A, 31B, 31C, and 31D.

Relief valves 33A, 33B, 33C, and 33D are connected to hydraulic pumps 31A, 31B, 31C, and 31D, respectively. Also, control valves 34A, 34B, 34C, and 34D are connected to relief valves 33A, 33B, 33C, and 33D, respectively. Also, bucket cylinder 35A, arm cylinder 35B, boom cylinder 35C, and hydraulic motor 35D for revolution are connected to control valves 34A, 34B, 34C, and 34D, respectively. Furthermore, pressure gauge 44 is connected to arm cylinder 35B.

In addition, one relief valve is not necessarily provided in each of hydraulic pumps 31A, 31B, 31C, and 31D. A single relief valve may be connected to a plurality of hydraulic pumps.

Each of relief valves 33A, 33B, 33C, and 33D can change the relief pressure (the upper limit set value) of the hydraulic oil. By way of example, relief valve 33A can change the relief pressure of the hydraulic oil in hydraulic pump 31A. Furthermore, each of relief valves 33A, 33B, 33C, and 33D can change the relief pressure of the hydraulic oil in the hydraulic pump connected to a corresponding one of these valves into one of two set values.

For the purpose of explanation, the following explanation will be made assuming that each of relief valves 33A, 33B, 33C, and 33D sets the relief pressure of the hydraulic oil in the hydraulic pump connected to a corresponding one of the valves at one of the first set pressure (for example, 300 $kg/cm^2$) and the second set pressure higher than the first set pressure (for example, 325 $kg/cm^2$). The numerical values of the first set pressure and the second set pressure may be set separately by each of relief valves 33A, 33B, 33C, and 33D. For example, the first set pressure in relief valve 33A and the first set pressure in relief valve 33B may have the same value or may have different values. In the following explanation, the "first set pressure" is defined as a default value.

Work vehicle 101 typically has: an operation mode in which the relief pressure is not changed (a default operation mode); and an operation mode in which the relief pressure is changed. The operator operation is performed for changing the operation mode from the operation mode in which the relief pressure is not changed to the operation mode in which the relief pressure is changed (hereinafter also referred to as a "power-up mode").

In the power-up mode, when a plurality of moving operations for moving excavated materials excavated by the excavation operation are performed, main controller 50 changes the relief pressures of relief valves 33A, 33B, 33C, and 33D from the first set pressure into the second set pressure. On the other hand, when the excavation operation is performed using bucket 7 even in the power-up mode, main controller 50 does not change the relief pressures of relief valves 33A, 33B, 33C, and 33D from the first set pressure to the second set pressure. In addition, the plurality of moving operations may include a boom raising operation, a hoist revolving operation, a dumping operation, and the like, as described above.

Work vehicle 101 needs to determine whether the operation that is currently performed is an excavation operation or an operation for moving excavated materials to a rack of a dump truck and the like. For making such a determination, the operation details about work implement levers 18 and 19 and the detection result achieved by pressure gauge 44 are used. The details of the determination process will be described later.

Pressure gauge 44 detects the hydraulic pressure (pressure of the hydraulic oil) applied to the bottom side of arm cylinder 35B. Pressure gauge 44 transmits the detection result to main controller 50.

Each of control valves 34A, 34B, 34C, and 34D is connected to work implement lever apparatus 41. Work implement lever apparatus 41 outputs, to control valves 34A, 34B, 34C, and 34D, a pilot pressure in accordance with a direction of operation and/or an amount of operation of work implement levers 18, 19 and travel levers 11, 12. Control valves 34A, 34B, 34C, and 34D control bucket cylinder 35A, arm cylinder 35B, boom cylinder 35C, and hydraulic motor 35D for revolution, respectively, in accordance with the pilot pressure.

Work implement levers 18, 19 and travel levers 11, 12 as well as lock lever 20 are connected to hydraulic pump 37.

Pressure sensor 47 is connected to work implement lever apparatus 41. Pressure sensor 47 outputs, to main controller 50, a lever operation signal in accordance with the operation states of work implement levers 18, 19 and travel levers 11, 12.

Main controller 50 carries out such control that each of hydraulic pumps 31A, 31B, 31C, and 31D absorbs best matching torque at each output point of engine 36, in accordance with: the pump absorption torque set according to the operator operation for each of work implement levers 18 and 19; the engine rotation speed set with throttle dial 39 or the like; the actual rotation speed of the engine; and the like.

Engine 36 has a drive shaft connected to hydraulic pumps 31A, 31B, 31C, and 31D and hydraulic pump 37.

Engine controller 38 controls the operation of engine 36 in accordance with an instruction from main controller 50. Engine 36 is a diesel engine by way of example. The rotation speed of engine 36 is set with throttle dial 39 or the like and the actual engine rotation speed is detected by rotation sensor 40. Rotation sensor 40 is connected to main controller 50.

Throttle dial 39 is provided with potentiometer 45. Potentiometer 45 detects the set value (operation amount) of throttle dial 39. The set value of throttle dial 39 is transmitted to main controller 50. Potentiometer 45 outputs a command value about the rotation speed of engine 36 to engine controller 38. The target rotation speed of engine 36 is adjusted according to this command value.

In response to an instruction from main controller 50, engine controller 38 controls an amount of injection of fuel injected by a fuel injector, thereby adjusting the rotation speed of engine 36. Engine controller 38 also adjusts the rotation speed of engine 36 in accordance with a control instruction from main controller 50 to each of hydraulic pumps 31A, 31B, 31C, and 31D.

Starter switch 46 is connected to engine controller 38. As the operator operates starter switch 46 (sets the starter switch to start), a start signal is output to engine controller 38 so that engine 36 starts.

Main controller 50 serves as a controller controlling overall work vehicle 101, and it is configured with a CPU (Central Processing Unit), a non-volatile memory, a timer, and the like. Main controller 50 controls engine controller 38, monitor device 21, and the like. Although main controller 50 and engine controller 38 are separate from each other in the present example, one common controller can also be provided.

Pressure switch 42 is connected to lock lever 20. Pressure switch 42 senses an operation of lock lever 20 when it is operated toward a locking side, and sends a signal to valve (solenoid valve) 43. Since valve 43 thus cuts off supply of oil, such functions as operation of work implement 4, revolution of revolving unit 3, and travel of traveling unit 1 can be stopped. In addition, pressure switch 42 sends a similar signal also to main controller 50.

In addition, work implement 4, engine 36, bucket 7, relief valves 33A, 33B, 33C, and 33D, main controller 50, arm 6, arm cylinder 35B, and pressure gauge 44 are examples of a "work implement", an "engine", a "bucket", a "relief valve", a "control unit", an "arm", an "arm cylinder", a "pressure detection unit", respectively, of the present invention.

Also, the above description has been made by way of example with regard to the configuration in which work vehicle 101 includes hydraulic pumps 31A, 31B, 31C, and 31D, swash plate drive apparatuses 32A, 32B, 32C, and 32D, and relief valves 33A, 33B, 33C, and 33D, but the present invention is not limited thereto. Alternatively, work vehicle 101 may be configured so as to include one hydraulic pump in place of hydraulic pumps 31A, 31B, 31C, and 31D; one swash plate drive apparatus in place of swash plate drive apparatuses 32A, 32B, 32C, and 32D, and one relief valve in place of relief valves 33A, 33B, 33C, and 33D.

E. FUNCTIONAL CONFIGURATION

Figure 4:
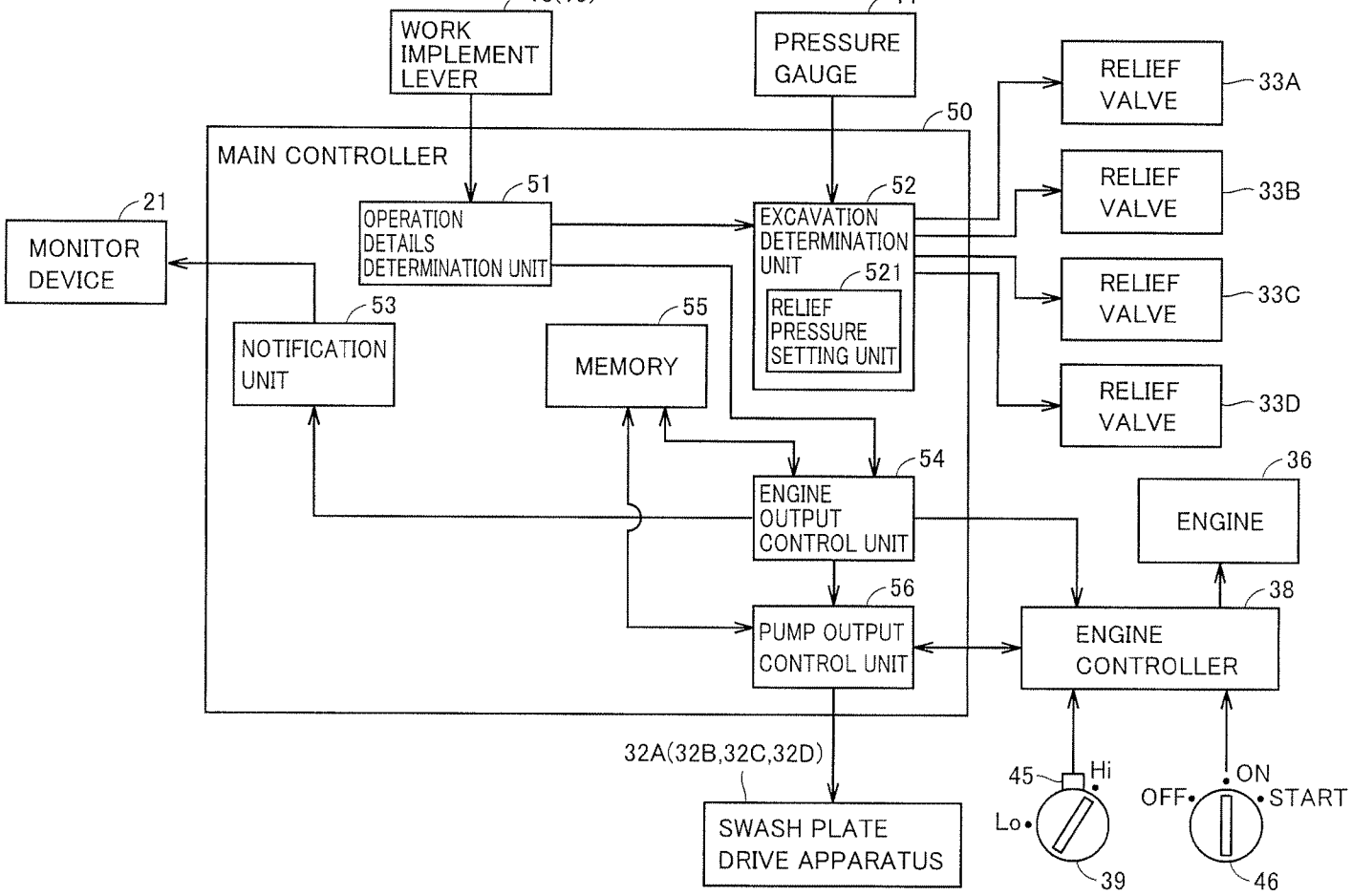
FIG. 4 is a functional block diagram illustrating a main controller in the control system of the work vehicle.

FIG. 4 is a functional block diagram illustrating main controller 50 in the control system of work vehicle 101.

FIG. 4 shows the relation between main controller 50 and other peripheral devices. The figure shows, as peripheral devices, work implement levers 18, 19, monitor device 21, a swash plate drive apparatus 32A, relief valves 33A to 33D, engine 36, engine controller 38, throttle dial 39, pressure gauge 44, potentiometer 45, and starter switch 46.

Main controller 50 controls the vehicle main body and work implement 4. Main controller 50 includes an operation details determination unit 51, an excavation determination unit 52, a notification unit 53, an engine output control unit 54, a memory 55, and a pump output control unit 56. Excavation determination unit 52 includes a relief pressure setting unit 521 configured to set the relief pressure of each of relief valves 33A, 33B, 33C, and 33D.

Notification unit 53 instructs monitor device 21 to give a notification about guidance information in response to the instruction from engine output control unit 54. Monitor device 21 displays prescribed guidance information in response to the instruction from notification unit 53.

Operation details determination unit 51 determines the operation details for work implement levers 18 and 19 performed by an operator. Operation details determination unit 51 determines as to which operation among the plurality of operations the work based on the operator's operation corresponds.

For example, operation details determination unit 51 determines the operation details for arm 6, and the operation details for bucket 7. When work implement levers 18 and 19 each accept the first predetermined operator operation, operation details determination unit 51 determines that the operation for causing arm 6 to perform excavation work has been accepted. Furthermore, when the work implement levers 18 and 19 each accept the second predetermined operator operation, operation details determination unit 51 determines that the operation for causing bucket 7 to perform excavation work has been accepted.

Operation details determination unit 51 outputs the determination result to excavation determination unit 52 and engine output control unit 54.

Memory 55 stores various pieces of information about the engine output torque control and the pump absorption torque control. Specifically, memory 55 stores information about the engine output torque curve and the pump absorption torque characteristic line. More specifically, memory 55 stores a plurality of engine output torque curves in association with the value of the throttle dial and the operation details. Also, memory 55 stores a plurality of pump absorption torque characteristic lines in association with the operation details.

Engine output control unit 54 receives an input of the determination result of the operation details from operation details determination unit 51. Furthermore, engine output control unit 54 accepts the information about the set value of throttle dial 39 from potentiometer 45. Based on the above-described determination result and the information about the above-described set value, engine output control unit 54 obtains an engine output torque curve to be used, from among the plurality of engine output torque curves stored in memory 55. Engine output control unit 54 instructs engine controller 38 to control engine 36 in accordance with the obtained engine output torque curve.

Engine controller 38 controls engine 36 in accordance with the engine output torque curve set by engine output control unit 54. Thereby, the torque that is set based on the rotation speed of engine 36 is output from engine 36 in accordance with the characteristics of the set engine output torque curve.

Pump output control unit 56 accepts the determination result of the operation details from operation details determination unit 51, and obtains a pump absorption torque characteristic line corresponding to the above-described determination result from among the plurality of pump absorption torque characteristic lines stored in memory 55.

Pump output control unit 56 controls a hydraulic pump (for example, hydraulic pump 37) in accordance with the obtained pump absorption torque characteristic line. Specifically, pump output control unit 56 controls a swash plate of the hydraulic pump (for example, hydraulic pump 37) in accordance with the engine rotation speed input from engine controller 38 in accordance with the pump absorption torque characteristic line set in accordance with the operation details.

Furthermore, pump output control unit 56 calculates a maximum absorption torque value at a target matching point M corresponding to the intersection point of the obtained pump absorption torque characteristic line and the engine output torque curve output from engine output control unit 54. Thereby, pump output control unit 56 controls the swash plate of the hydraulic pump such that the torque value in the hydraulic pump (for example, hydraulic pump 37) does not exceed the maximum absorption torque value.

Engine output control unit 54 performs output control while (i) setting, as a target rotation speed, the rotation speed of engine 36 at an intersection point (that is, a target matching point) of the engine output torque curve obtained from memory 55 and the pump absorption torque characteristic line of the hydraulic pump, and (ii) setting the torque of the engine at the above-mentioned intersection point as a target torque.

Then, excavation determination unit 52 will be hereinafter described. Excavation determination unit 52 determines whether the excavation operation using bucket 7 is currently performed (hereinafter simply also referred to as "during an excavation operation") or not. Specifically, excavation determination unit 52 determines whether the ground is currently excavated or not in the state where at least the cutting edge of the bucket is in contact with the excavation surface such as the ground.

More specifically, excavation determination unit 52 determines based on the determination results from pressure gauge 44 and operation details determination unit 51 whether the excavation operation is currently performed or not, which will be specifically described as below.

Excavation determination unit 52 determines that the excavation operation is currently performed, on the conditions: that work implement levers 18 and 19 each accept an operation for causing arm 6 to perform excavation work (hereinafter also referred to as a "lever operation for arm excavation"); and that the pressure detected by pressure gauge 44 is equal to or greater than a predetermined value. Furthermore, excavation determination unit 52 determines that the excavation operation is currently performed on the conditions: that work implement levers 18 and 19 each accept an operation for causing bucket 7 to perform excavation work (hereinafter also referred to as a "lever operation for bucket excavation"); and that the pressure detected by pressure gauge 44 (the pressure of the hydraulic oil supplied to arm cylinder 35B) is equal to or greater than the predetermined value. In addition, the predetermined value (hereinafter also referred to as a "threshold value") may be 100 kg/cm$^2$, for example.

As described above, excavation determination unit 52 determines that the excavation operation is currently performed on the conditions: that work implement levers 18 and 19 accept one of the lever operation for arm excavation and the lever operation for bucket excavation; and that the hydraulic pressure applied to the bottom side of arm cylinder 35B is equal to or greater than the threshold value.

Here, it is assumed that excavation determination unit 52 is configured to determine whether the excavation operation is currently performed or not only in consideration of the hydraulic pressure applied to the bottom side of arm cylinder 35B without consideration of the lever operation for arm excavation or bucket excavation. In this case, when bucket 7 contains sand, soil and the like, this excavation determination unit 52 may determine that the excavation operation is currently performed even during a dumping operation in the air. Thus, in order not to determine such a dumping operation as an excavation operation, excavation determination unit 52 determines that the excavation operation is currently performed on the condition that the lever operation for excavation by arm 6 or the bucket is currently performed.

On the other hand, it is assumed that excavation determination unit 52 is configured to determine whether the excavation operation is currently performed or not in consideration of only the lever operation for excavation by arm 6 or the bucket without consideration of the hydraulic pressure applied to the bottom side of arm cylinder 35B. In this case, excavation determination unit 52 determines that the excavation operation is currently performed even during the operation in the air (specifically, the operation of work implement 4 in the state where bucket 7 is not in contact with the excavation surface).

Accordingly, when excavation determination unit 52 determines whether the excavation operation is currently performed or not, not only the lever operation for excavation by arm 6 or the bucket is utilized as described above, but also the hydraulic pressure applied to the bottom side of arm cylinder 35B is utilized. The determination process performed using such two indicators is a process specific to a hydraulic excavator. Thus, it cannot be conceived that such a determination process is applicable to a wheel loader or the like.

In the power-up mode, when it is determined that the excavation operation is not currently performed, relief pressure setting unit 521 in excavation determination unit 52 changes the relief pressure of each of relief valves 33A to 33D from the first set pressure (default value) to the second set pressure higher than the first set pressure. On the other hand, even in the power-up mode, when it is determined that the excavation operation is currently performed, relief pressure setting unit 521 does not change the relief pressure of each of relief valves 33A to 33D from the first set pressure to the higher second set pressure.

In this way, on the conditions that the pressure detected by pressure gauge 44 is equal to or greater than the predetermined value, and that operation details determination unit 51 determines that the operation details indicate an excavation operation to be performed by arm 6, relief pressure setting unit 521 sets the relief pressure of each of relief valves 33A to 33D at the first set pressure. When the conditions are not satisfied, relief pressure setting unit 521 sets the relief pressure of each of relief valves 33A to 33D at the second set pressure.

By the above-described process, in work vehicle 101, power-up is implemented during the above-described plurality of moving operations (a boom raising operation, a hoist revolving operation, a dumping operation, and the like) while power-up is not implemented during the excavation operation. Specifically, work vehicle 101 performs each of the above-described plurality of moving operations in the second state that is greater in energy consumption per unit time than the first state, and performs an excavation operation in the first state.

According to this configuration, it becomes possible to prevent that work vehicle 101 is determined as being currently performing an excavation operation even though bucket 7 is not in contact with the excavation surface such as the ground. Accordingly, it is accurately determined whether the excavation operation is currently performed or not, so that power-up can be implemented during the above-described plurality of moving operations. Furthermore, main controller 50 performs each of the plurality of moving operations for moving the excavated materials excavated by the excavation operation in the second state (the state where power-up is implemented) that is greater in energy consumption per unit time than during the excavation operation. Thus, each of the plurality of moving operations can be performed immediately as compared with the case where each of the plurality of moving operations is performed in the first state (the default state where power-up is not implemented). Consequently, a series of operations including an excavation operation can be immediately performed. Furthermore, main controller 50 performs the excavation operation in the first state (in the state where power-up is not implemented). Accordingly, a load to be applied onto work vehicle 101 can be reduced as compared with the case where the excavation operation is performed in the second state (in the state where power-up is implemented).

E. CONTROL STRUCTURE

Figure 5:
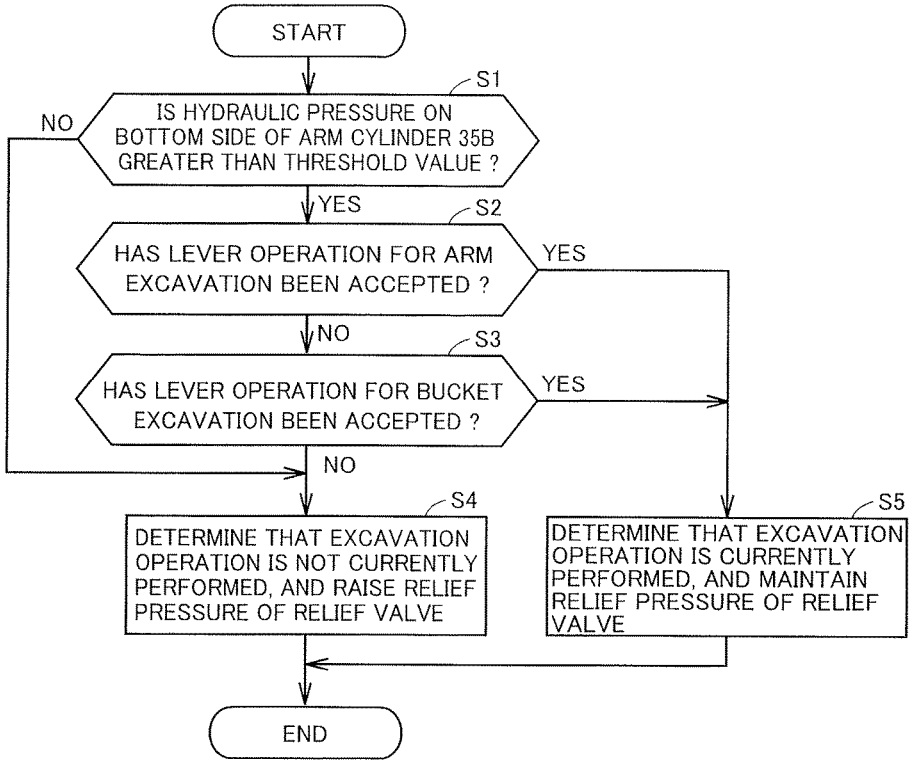
FIG. 5 is a flowchart for illustrating a flow of the process performed in the work vehicle.

FIG. 5 is a flowchart for illustrating a flow of the process performed in work vehicle 101. As shown in FIG. 5, main controller 50 (specifically, a processor) determines in step S1 whether the hydraulic pressure on the bottom side of arm cylinder 35B is greater than a threshold value or not.

If it is determined that the hydraulic pressure is greater than the threshold value (YES in step S1), main controller 50 determines in step S2 whether the lever operation for arm excavation has been accepted or not. If it is determined that the hydraulic pressure is not greater than the threshold value (NO in step S1), main controller 50 causes the process to proceed to step S4.

If it is determined that the lever operation for arm excavation has been accepted (YES in step S2), main controller 50 determines in step S5 that the excavation operation is currently performed, and then, maintains the relief pressure of each of relief valves 33A to 33D at the first set pressure. If it is determined that the lever operation for arm excavation has not been accepted (NO in step S2), main controller 50 determines in step S3 whether the lever operation for bucket excavation has been accepted or not.

If it is determined that the lever operation for bucket excavation has been accepted (YES in step S3), main controller 50 causes the process to proceed to step S5. If it is determined that the lever operation for bucket excavation has not been accepted (NO in step S3), main controller 50 determines in step S4 that the excavation operation is not currently performed, and then, raises the relief pressure of each of relief valves 33A to 33D from the first set pressure to the second set pressure.

Through the above-described series of processes, work vehicle 101 can reduce the load to be applied onto work vehicle 101 and also can immediately perform a series of operations including an excavation operation.

F. MODIFICATION f1. First Modification

The above-described embodiment has been described by way of example with regard to the configuration in which the relief pressure of each of relief valves 33A to 33D is changed from the first set pressure (a default value) to the second set pressure higher than the first set pressure, on the condition that the power-up mode is implemented. However, work vehicle 101 does not necessarily need to have a power-up mode. Even if work vehicle 101 has only a normal operation mode, this work vehicle 101 only has to be configured to change the relief pressure of each of relief valves 33A to 33D depending on whether the excavation operation is currently performed or not.

f2. Second Modification

The above-described embodiment has been described by way of example with regard to the configuration in which pressure gauge 44 detects the hydraulic pressure applied to the bottom side of arm cylinder 35B. However, the present invention is not limited to the above. For example, pressure gauge 44 may be arranged so as to detect the hydraulic pressure applied to a position of arm cylinder 35B other than that on its bottom side.

f3. Third Modification

Work vehicle 101 may be configured such that bucket 7 includes a pressure gauge for detecting the pressure of the hydraulic oil supplied to bucket cylinder 35A together with pressure gauge 44 or in place of pressure gauge 44. The pressure gauge provided in bucket 7 may be disposed at a position at which it detects the hydraulic pressure applied to the bottom side of bucket cylinder 35A, for example.

In the case of such a configuration, relief pressure setting unit 521 sets the relief pressure of each of relief valves 33A to 33D at the first set pressure on the conditions: that the pressure detected by the pressure gauge provided in bucket 7 is equal to or greater than a predetermined value; and that the operation details determination unit 51 determines that the operation details indicate an excavation operation performed by bucket 7. If the above-described conditions are not satisfied, relief pressure setting unit 521 sets the relief pressure of each of relief valves 33A to 33D at the second set pressure.

In this way, even in the configuration in which the pressure of the hydraulic oil supplied to bucket cylinder 35A is detected, it becomes possible to achieve the same effects as those achieved in the configuration (the configuration in the embodiment) in which the pressure of the hydraulic oil supplied to arm cylinder 35B is detected.

f4. Fourth Modification

In the above-described embodiment, operations such as a boom raising operation, a hoist revolving operation, a dumping operation have been described as examples of a plurality of moving operations for moving the excavated materials excavated by the excavation operation. Furthermore, the plurality of moving operations have been described by way of example with regard to the configuration in which, in the power-up mode, the relief pressure of each of relief valves 33A to 33D is changed from the first set pressure (a default value) to the second set pressure higher than the first set pressure. However, the present invention is not limited to the above, but may have a configuration in which the relief pressure of each of relief valves 33A to 33D is raised when performing at least two of operations such as a boom raising operation, a hoist revolving operation, and a dumping operation. Also, the present invention may have a configuration, for example, in which the relief pressure is raised during the boom raising operation and the hoist revolving operation while the relief pressure is not raised during the dumping operation.

f5. Fifth Modification

It is not necessary to simultaneously raise the relief pressures of all of relief valves 33A to 33D. At least, main controller 50 may raise only the relief pressure of the relief valve related to the moving operation.

f6. Sixth Modification (1) The above-described embodiment has been described with regard to an example in which the relief pressure of the relief valve connected to the hydraulic pump is raised, thereby implementing shifting from the first state (a default state where power-up is not implemented) to the second state (the state where power-up is implemented). However, the present invention is not limited to the above. For example, work vehicle 101 may implement shifting from the first state to the second state by changing the horsepower curve to be used.

Figure 6:
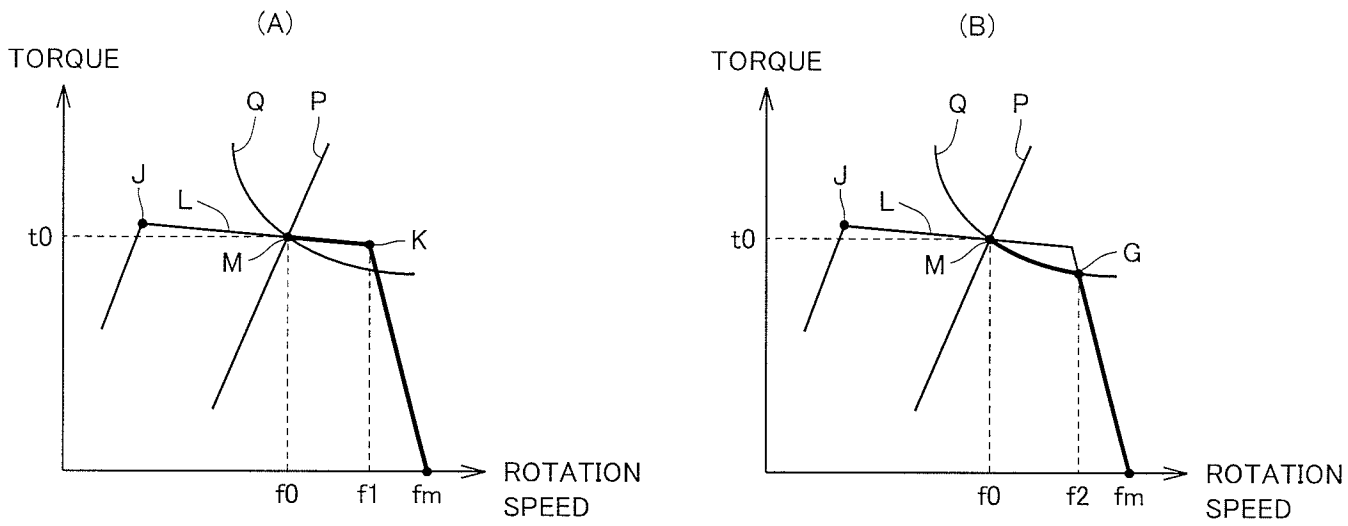
FIG. 6 is a diagram for illustrating the configuration for changing a horsepower curve.

FIG. 6 is a diagram for illustrating the configuration for changing a horsepower curve. Specifically, FIG. 6 is a diagram for illustrating an engine output torque curve L used by engine output control unit 54 at least in a range from a target rotation speed f0 to a no-load maximum rotation speed fm.

FIG. 6(A) is a diagram for illustrating the horsepower curve used by engine output control unit 54 when work vehicle 101 performs the above-described plurality of moving operations. FIG. 6(B) is a diagram for illustrating the horsepower curve used by engine output control unit 54 when work vehicle 101 performs an excavation operation.

As shown in FIG. 6(A), when the above-described plurality of moving operations are performed, engine output control unit 54 performs output control in line with engine output torque curve L in a range from target rotation speed f0 to no-load maximum rotation speed fm. Specifically, engine output control unit 54 performs output control using a maximum horsepower point K on engine output torque curve L. By such control, engine 36 can produce the maximum horsepower on engine output torque curve L, so that the workability can be improved.

As shown in FIG. 6(B), when the excavation operation is performed, engine output control unit 54 performs output control in line with an equivalent horsepower curve Q in a range from target rotation speed f0 to a rotation speed f2 at a point G. In addition, engine output control unit 54 performs output control in line with engine output torque curve L in a range from rotation speed f2 to no-load maximum rotation speed fm. By such control, engine 36 does not have to produce the maximum horsepower on engine output torque curve L.

In addition, no-load maximum rotation speed fm represents the rotation speed of the engine that is increased to the maximum level when a load is released. Also, rotation speed f1 and torque t0 represent the rotation speed and the torque, respectively, at maximum horsepower point K. Furthermore, in FIG. 6, pump absorption torque characteristic line P is set to be a monotonically increasing function at least in a prescribed rotation speed range including a target matching point. Also, engine output torque curve L is set to be a monotonically decreasing function in a range from a rated point J to maximum horsepower point K.

(2) Furthermore, work vehicle 101 may implement shifting from the first state to the second state by increasing the rotation speed of the engine. For example, when work vehicle 101 uses engine output torque curve L shown in FIG. 6, the output horsepower can be raised by increasing the rotation speed of the engine at least in a region in which the rotation speed is equal to or less than rotation speed f1.

Accordingly, during the above-described plurality of moving operations, shifting from the first state to the second state can be implemented by increasing the rotation speed of the engine.

(3) Shifting from the first state to the second state may be implemented by raising the relief pressure of the relief valve connected to the hydraulic pump, and also by changing the horsepower curve to be used as described above. Alternatively, shifting from the first state to the second state may be implemented by raising the relief pressure of the relief valve connected to the hydraulic pump and also by increasing the rotation speed of the engine as described above.

According to the above-described configurations, the second state can be set such that the energy consumption per unit time is much higher than that in the case where the relief pressure is only set at the second set value.

The embodiments disclosed herein are by way of example, but not limited only to the above-described description. The scope of the present invention is defined by the terms of the claims, and is intended to include any modifications within the meaning and scope equivalent to the terms of the claims.

REFERENCE SIGNS LIST

1 traveling unit, 3 revolving unit, 4 work implement, 5 boom, 6 arm, 7 bucket, 8 operator's compartment, 9 operator's seat, 10 travel operation unit, 11, 12 travel lever, 18, 19 work implement lever, 22 front window, 31A, 31B, 31C, 31D, 37 hydraulic pump, 32A, 32B, 32C, 32D swash plate drive apparatus, 33A, 33B, 33C, 33D relief valve, 34A, 34B, 34C, 34D control valve, 35A bucket cylinder, 35B arm cylinder, 35C boom cylinder, 35D hydraulic motor for revolution, 36 engine, 38 engine controller, 40 rotation sensor, 41 work implement lever apparatus, 44 pressure gauge, 50 main controller, 51 operation details determination unit, 52 excavation determination unit, 54 engine output control unit, 56 pump output control unit, 101 work vehicle, 521 relief pressure setting unit.

The invention claimed is:

1. A work vehicle comprising:

a vehicle main body;

a work implement attached to the vehicle main body and including an arm connected to a bucket;

an arm cylinder configured to operate the arm with hydraulic oil supplied through a hydraulic circuit;

a pressure detection unit for detecting pressure of the hydraulic oil supplied to the arm cylinder;

an operation details determination unit for determining operation details for the arm;

a variable-type relief valve capable of setting a relief pressure of the hydraulic oil in the hydraulic circuit at one of a first set pressure and a second set pressure higher than the first set pressure;

a relief pressure setting unit for setting the relief pressure of the variable-type relief valve at the first set pressure on conditions that the pressure detected by the pressure detection unit is equal to or greater than a predetermined value, and that the operation details determination unit determines that the operation details indicate an excavation operation, and setting the relief pressure of the variable-type relief valve at the second set pressure when the conditions are not satisfied;

an engine; and a control unit for controlling a rotation speed of the engine and controlling the work implement utilizing an output of the engine, wherein the control unit is configured to increase the rotation speed of the engine to be higher when the conditions are not satisfied than when the conditions are satisfied.

2. The work vehicle according to claim 1, wherein the pressure detection unit is configured to detect the pressure of the hydraulic oil on a side of a bottom of the arm cylinder.

3. A work vehicle comprising:

a vehicle main body;

a work implement attached to the vehicle main body and including a bucket;

a bucket cylinder configured to operate the bucket with hydraulic oil supplied through a hydraulic circuit;

a pressure detection unit for detecting pressure of the hydraulic oil supplied to the bucket cylinder;

an operation details determination unit for determining operation details for the bucket;

a variable-type relief valve capable of setting a relief pressure of the hydraulic oil in the hydraulic circuit at one of a first set pressure and a second set pressure higher than the first set pressure;

a relief pressure setting unit for setting the relief pressure of the variable-type relief valve at the first set pressure on conditions that the pressure detected by the pressure detection unit is equal to or greater than a predetermined value, and that the operation details determination unit determines that the operation details indicate an excavation operation, and setting the relief pressure of the variable-type relief valve at the second set pressure when the conditions are not satisfied;

an engine; and a control unit for controlling a rotation speed of the engine and controlling the work implement utilizing an output of the engine, wherein the control unit is configured to increase the rotation speed of the engine to be higher when the conditions are not satisfied than when the conditions are satisfied.

4. The work vehicle according to claim 3, wherein the pressure detection unit is configured to detect the pressure of the hydraulic oil on a side of a bottom of the bucket cylinder.

5. The work vehicle according to claim 1, further comprising:

a storage unit for storing, as a horsepower curve of the engine, a first horsepower curve and a second horsepower curve that is greater in horsepower than the first horsepower curve, wherein the control unit is configured to control the work implement using the first horsepower curve when the conditions are satisfied, and control the work implement using the second horsepower curve when the conditions are not satisfied.

6. A method of controlling an operation performed in a work vehicle, the work vehicle including: a vehicle main body; a work implement attached to the vehicle main body and including an arm connected to a bucket; an arm cylinder configured to operate the arm with hydraulic oil supplied through a hydraulic circuit; a variable-type relief valve capable of setting a relief pressure of the hydraulic oil in the hydraulic circuit at one of a first set pressure and a second set pressure higher than the first set pressure; an engine; and a control unit for controlling a rotation speed of the engine, the method comprising:

detecting pressure of the hydraulic oil supplied to the arm cylinder;

determining operation details for the arm;

setting the relief pressure of the variable-type relief valve at the first set pressure on conditions that the pressure detected is equal to or greater than a predetermined value, and that it is determined that the operation details indicate an excavation operation, and setting the relief pressure of the variable-type relief valve at the second set pressure when the conditions are not satisfied;

controlling the rotation speed of the engine and controlling the work implement utilizing an output of the engine; and increasing the rotation speed of the engine to be higher when the conditions are not satisfied than when the conditions are satisfied.

7. A method of controlling an operation performed in a work vehicle, the work vehicle including: a vehicle main body; a work implement attached to the vehicle main body and including a bucket; a bucket cylinder configured to operate the bucket with hydraulic oil supplied through a hydraulic circuit; a variable-type relief valve capable of setting a relief pressure of the hydraulic oil in the hydraulic circuit at one of a first set pressure and a second set pressure higher than the first set pressure; an engine; and a control unit for controlling a rotation speed of the engine, the method comprising:

detecting pressure of the hydraulic oil supplied to the bucket cylinder;

determining operation details for the bucket;

setting the relief pressure of the variable-type relief valve at the first set pressure on conditions that the pressure detected is equal to or greater than a predetermined value, and that it is determined that the operation details indicate an excavation operation, and setting the relief pressure of the variable-type relief valve at the second set pressure when the conditions are not satisfied;

controlling the rotation speed of the engine and controlling the work implement utilizing an output of the engine; and increasing the rotation speed of the engine to be higher when the conditions are not satisfied than when the conditions are satisfied.

8. The work vehicle according to claim 3, further comprising:

a storage unit for storing, as a horsepower curve of the engine, a first horsepower curve and a second horsepower curve that is greater in horsepower than the first horsepower curve, wherein the control unit is configured to control the work implement using the first horsepower curve when the conditions are satisfied, and control the work implement using the second horsepower curve when the conditions are not satisfied.

9. The method of controlling an operation performed in a work vehicle according to claim 6, further comprising:

storing in a storage unit, as a horsepower curve of the engine, a first horsepower curve and a second horsepower curve that is greater in horsepower than the first horsepower curve;

controlling the work implement using the first horsepower curve when the conditions are satisfied; and controlling the work implement using the second horsepower curve when the conditions are not satisfied.

10. The method of controlling an operation performed in a work vehicle according to claim 7, further comprising:

storing in a storage unit, as a horsepower curve of the engine, a first horsepower curve and a second horsepower curve that is greater in horsepower than the first horsepower curve;

controlling the work implement using the first horsepower curve when the conditions are satisfied; and controlling the work implement using the second horsepower curve when the conditions are not satisfied.

* * * * *